US007268734B2

(12) United States Patent
Cislo

(10) Patent No.: US 7,268,734 B2
(45) Date of Patent: Sep. 11, 2007

(54) REMOVABLE MOUNTABLE AERODYNAMIC BAYONET ANTENNA APPARATUS AND METHOD

(75) Inventor: Donald M. Cislo, Glendale Heights, IL (US)

(73) Assignee: Antenex, Inc., Glendale Heights, IL (US)

( * ) Notice: Subject to any disclaimer, the term of this patent is extended or adjusted under 35 U.S.C. 154(b) by 25 days.

(21) Appl. No.: 11/345,763

(22) Filed: Feb. 2, 2006

(65) Prior Publication Data

US 2007/0176844 A1 Aug. 2, 2007

(51) Int. Cl.
*H01Q 1/32* (2006.01)

(52) U.S. Cl. ..... 343/713; 343/711; 343/878

(58) Field of Classification Search ..... 343/711, 343/713, 878
See application file for complete search history.

(56) References Cited

U.S. PATENT DOCUMENTS

| | | | |
|---|---|---|---|
| 2,234,737 | A | 3/1941 | Mace |
| 2,299,785 | A | 10/1942 | Barrett |
| 2,449,562 | A | 9/1948 | Meier |
| 2,473,141 | A | 6/1949 | Friedberg |
| D157,090 | S | 1/1950 | Schmidt |
| 2,505,424 | A | 4/1950 | Moseley |
| D176,495 | S | 1/1956 | Berdass |
| 2,748,905 | A | 6/1956 | Avruch |
| 2,931,897 | A | 4/1960 | Tuve |
| 3,138,661 | A | 6/1964 | Grashow |
| 3,666,902 | A | 5/1972 | Owen et al. |
| D225,221 | S | 11/1972 | Sikorski et al. |
| 3,898,666 | A | 8/1975 | Massa |
| 4,021,809 | A | 5/1977 | Klancnik |
| 4,047,779 | A | 9/1977 | Klancnik |
| 4,173,761 | A | 11/1979 | Liautaud |
| 4,179,698 | A | 12/1979 | Liautaud |
| 4,198,638 | A | 4/1980 | Carolus |
| 4,210,914 | A | 7/1980 | Blackman |
| 4,243,989 | A | 1/1981 | Piper |
| 4,282,526 | A | 8/1981 | Alf et al. |
| D287,588 | S | 1/1987 | Ulch |
| D293,575 | S | 1/1988 | Sugiura |
| 4,867,698 | A | 9/1989 | Griffiths |
| 5,015,194 | A | 5/1991 | Seas |
| 5,166,695 | A | 11/1992 | Chan et al. |
| 5,184,142 | A | 2/1993 | Hornburg et al. |
| D356,314 | S | 3/1995 | Rich et al. |
| D357,683 | S | 4/1995 | Cline et al. |
| D361,569 | S | 8/1995 | Jervis |
| D388,095 | S | 12/1997 | Niijima et al. |
| D413,470 | S | 9/1999 | Burton |

(Continued)

FOREIGN PATENT DOCUMENTS

| | | |
|---|---|---|
| GB | 2192757 | 1/1988 |

*Primary Examiner*—Hoang V. Nguyen
(74) *Attorney, Agent, or Firm*—Harness, Dickey & Pierce, P.L.C.

(57) ABSTRACT

Exemplary embodiments of mountable antenna apparatuses and methods are disclosed. In one exemplary embodiment, a mountable antenna apparatus generally includes a housing member, a bayonet adapter, and an antenna assembly disposed within the housing member. The housing member may include an aerodynamic configuration for reducing drag on and for eliminating or reducing fatigue as well as flutter of the antenna assembly. The aerodynamic configuration may include a feature such as an ogive, an ogivoid, a semi-ogivoid, a hemi-ogivoid, and a quasi-ogivoid.

29 Claims, 4 Drawing Sheets

U.S. PATENT DOCUMENTS

| | | | | |
|---|---|---|---|---|
| D414,773 | S | 10/1999 | Heiligenstein et al. | |
| D418,840 | S | 1/2000 | Cota et al. | |
| 6,023,245 | A | 2/2000 | Gomez et al. | |
| D429,720 | S | 8/2000 | Strand | |
| 6,236,377 | B1 | 5/2001 | Hussaini et al. | |
| D443,263 | S | 6/2001 | Strand et al. | |
| D461,796 | S | 8/2002 | Boyer | |
| 6,469,678 | B1 | 10/2002 | Pullen | |
| D465,480 | S | 11/2002 | Boyer | |
| D470,131 | S | 2/2003 | Noro et al. | |
| D470,481 | S | 2/2003 | Ikeda | |
| D472,892 | S | 4/2003 | Tourres | |
| D474,931 | S | 5/2003 | Bladwin et al. | |
| D480,712 | S | 10/2003 | Noro | |
| D481,028 | S | 10/2003 | Wu | |
| D482,350 | S | 11/2003 | Noro et al. | |
| 6,657,589 | B2 | 12/2003 | Wang et al. | |
| D489,712 | S | 5/2004 | Nagatomi | |
| D491,926 | S | 6/2004 | Tai et al. | |
| D493,447 | S | 7/2004 | Noro et al. | |
| 6,762,727 | B2 * | 7/2004 | Rochford et al. | 343/713 |
| D501,201 | S | 1/2005 | Chiang et al. | |
| 7,002,523 | B2 | 2/2006 | Noro et al. | |
| 7,004,666 | B2 * | 2/2006 | Kozlovski | 403/252 |
| D519,991 | S | 5/2006 | Chapman | |
| 7,091,912 | B2 * | 8/2006 | Iacovella et al. | 343/713 |
| D531,996 | S | 11/2006 | Cislo | |
| D542,283 | S | 5/2007 | Cislo | |
| D542,783 | S | 5/2007 | Cislo | |
| 2004/0174311 | A1 * | 9/2004 | Kordass et al. | 343/711 |
| 2004/0183734 | A1 | 9/2004 | Noro et al. | |
| 2006/0103579 | A1 * | 5/2006 | Blickle | 343/711 |

* cited by examiner

REMOVABLE MOUNTABLE AERODYNAMIC BAYONET ANTENNA APPARATUS AND METHOD

TECHNICAL FIELD

The present invention relates to antenna apparatuses and methods. More particularly, the present invention relates to antenna apparatuses and methods for vehicles. Even more particularly, the present invention relates to removable mountable antenna apparatuses and methods for vehicles.

BACKGROUND ART

A common current vehicle antenna in the related art is an antenna rod which is fastened to a base using a quick-connect coupling assembly; and the second quick-connect coupling assembly connects an antenna cable with a terminal on a radio. Another antenna apparatus is mounted onto a vehicle by a base and a fastener, wherein the base is removably attached to the vehicle, the base including a mounting portion and a housing component. The mounting portion has a main body with an arm therefrom extending, a top portion, and an engaging element for removably attaching the base assembly to the vehicle. The housing is coupled to the base; and the fastener has a guide structure for engaging the arm, whereby the base assembly is secured to the vehicle. Another related art device is an antenna apparatus which is mounted by a semi-hemispherical mounting shell, wherein the base is secured to the shell's exterior surface by a pin, and wherein the mounting angle of the antenna is adjusted via a bridging plate within the shell.

Another related art invention involves a device for protecting an antenna comprising a "cap" or a boot structure, wherein the cap fits downwardly into a housing and is provided with slots for engaging pins which are secured to the housing. Yet another related art antenna is a telescoping mast configuration being insulated from the vehicle body, wherein an insulator is secured in a metallic sleeve. A portion of the sleeve projects from the insulator and has an exterior threaded portion, wherein an end of the threaded portion has a pair of slots. Another device comprises a coaxial connector for coupling an antenna to a walkie-talkie radio, wherein the connector has a center contact member for electrically coupling the antenna to the radio and a collar for mechanically coupling the connector to an outer contact of a complementary coaxial connector in the radio without electrically coupling the connector to the outer contact.

A further related art apparatus comprises a quick-disconnect structure for antennas and coaxial cables with no relative movement between the connector components, wherein a clamp is threadably engaged with a nylon sleeve, the sleeve having an internal passageway which has internal ramps for engaging the pins of a connector upon rotation of the sleeve, and wherein a contact shoulder is engaged with the clamp and is compressively urged against the connector. However, these related art antennas, at least in part, remain exposed to hazards, such as corrosion, accidental structural damage, vandalism, drag, fatigue, and flutter. Thus, a long-felt need is seen to exist for an antenna apparatus and a method which is removably mountable, strategically repositionable, and which protects the antenna circuitry from such hazards as currently experienced in the art.

DISCLOSURE OF THE INVENTION

The present invention mountable antenna apparatus generally comprises a housing member, a bayonet adapter, and an antenna assembly being disposed within the housing member. The present apparatus comprises a broad-band "no-tune" antenna assembly. The housing member comprises an aerodynamic configuration for reducing drag on, and for eliminating fatigue as well as flutter of, the antenna assembly. The aerodynamic configuration comprises a feature such as an ogive, an ogivoid, a semi-ogivoid, a hemi-ogivoid, and a quasi-ogivoid. The housing member also comprises a convex feature for facilitating manual installation and repositioning of the antenna assembly. This convex feature is disposed on either side of the housing member for easy gripping during installation. The convex feature comprises a configuration such as a parabola, a paraboloid, a semi-paraboloid, a hemi-paraboloid, a quasi-paraboloid, an ellipse, an ellipsoid, a semi-ellipsoid, a hemi-ellipsoid, and a quasi-ellipsoid. The housing member comprises a housing recess formed in its bottom surface and an annulus having a bayonet pin thereon formed and being disposed within the housing recess. The bayonet adapter comprises a ramped recess with an insertion notch formed on its outer surface for engaging each corresponding bayonet pin and having an internal threading for mating an NMO mount, e.g., a New Motorola™ antenna mount. The antenna assembly comprises a contact being disposed through the housing member and within the housing recess for electrical coupling with the NMO mount.

The present invention method for mounting an antenna apparatus generally comprises the steps of providing a housing member, providing a bayonet adapter, providing an antenna assembly within the top housing member, removing a preexisting NMO ring from an NMO mount, retrofitting the NMO mount with the bayonet adapter, thereby effecting a retrofitted NMO mount, and fastening the antenna assembly within the housing member to the retrofitted NMO mount. The present method further comprises the step of providing the housing member with an aerodynamic configuration. The aerodynamic configuration providing step includes providing a feature such as an ogive, an ogivoid, a semi-ogivoid, a hemi-ogivoid,. and a quasi-ogivoid. The present method further comprises the step of providing the housing member with a convex feature for facilitating manual installation and repositioning of the antenna assembly, wherein the convex feature providing step comprises providing at least one configuration such as a parabola, a paraboloid, a semi-paraboloid, a hemi-paraboloid, a quasi-paraboloid, an ellipse, an ellipsoid, a semi-ellipsoid, a hemi-ellipsoid, and a quasi-ellipsoid.

An advantage of the present invention is the protection of the antenna assembly, containing the delicate antenna circuitry, from corrosion, short-circuiting, fatigue, accidental damage, and vandalism. Other advantages include optimization of the signal transmission and the reduction of drag on, and the elimination of fatigue as well as flutter of, the antenna assembly. Further advantages include the enabling of rapid alignment of the antenna assembly during installation and an omni-directional radiation pattern which allows either edge of the apparatus to function as a leading edge without adversely affecting performance. Other features of the present invention are disclosed, or are apparent, in the section entitled "Modes for Carrying Out the Invention," disclosed, infra.

BRIEF DESCRIPTION OF THE DRAWINGS

For better understanding of the present invention, reference is made to the below-referenced accompanying Drawings. Reference numbers refer to the same or equivalent parts of the present invention throughout the several figures of the Drawings.

MODES FOR CARRYING OUT THE INVENTION

Figure 1:
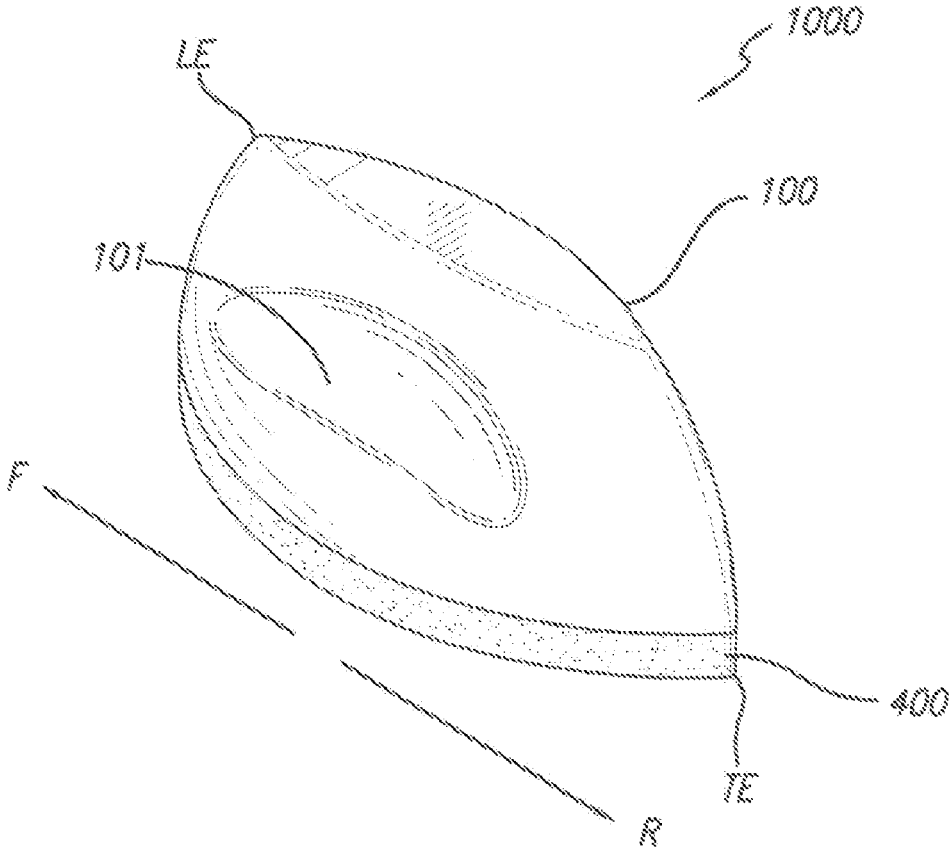
FIG. 1 is a perspective view of a mountable antenna apparatus, in accordance with the present invention.
Figure 2:
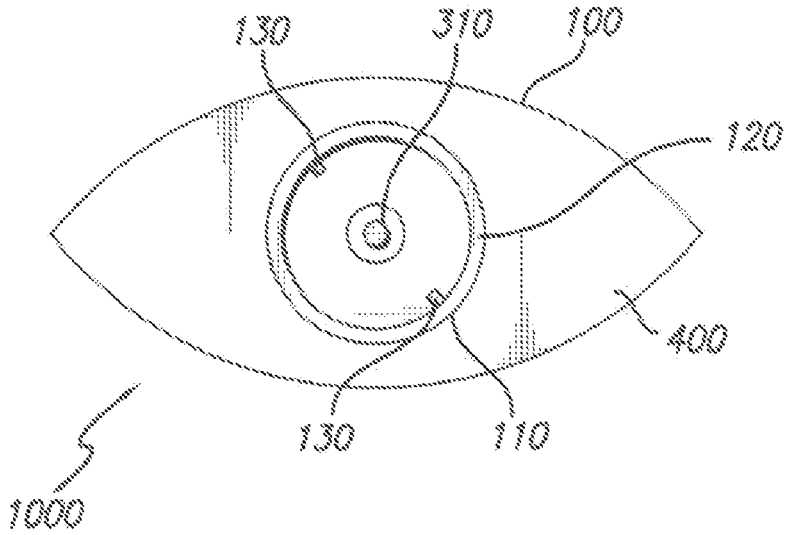
FIG. 2 is a bottom view of mountable antenna apparatus, in accordance with the present invention.

FIG. 1 illustrates, in a perspective view, a mountable antenna apparatus 1000, comprising, a housing member 100, a bayonet adapter 200 (FIGS. 3 through 8), and an antenna assembly (the antenna assembly contact 310 is shown in FIG. 2) being disposed within the housing member 100, in accordance with the present invention. The housing member 100 comprises an aerodynamic configuration. The aerodynamic configuration comprises a feature such as an ogive, an ogivoid, a semi-ogivoid, a hemi-ogivoid, and a quasio-givoid. The housing member 100 also comprises a convex feature 101 for facilitating manual installation and repositioning (gripping) of the antenna assembly, wherein the convex feature 101 comprises a configuration such as a parabola, a paraboloid, a semi-paraboloid, a hemiparaboloid, a quasi-paraboloid, an ellipse, an ellipsoid, a semi-ellipsoid, a hemi-ellipsoid, and a quasi-ellipsoid. Preferably, the housing member 100 can be disposed with a leading edge LE oriented toward the front F of a vehicle and a trailing edge TE oriented toward the rear R of the vehicle for minimizing the aerodynamic loads. Alternatively, the housing member 100 can be disposed with a leading edge LE and a trailing edge TE being oriented outboard of the vehicle.

Still referring to FIG. 1, the housing member 100 comprises a material such as a polymer and a composite material, wherein the polymer comprises a plastic such as a molded ABS plastic and an injection molded ABS plastic, by example only. The antenna assembly comprises the following electrical characteristics: a frequency range of approximately 150 MHz to approximately 155 MHz, a bandwidth of approximately 5 MHz at approximately 2.0:1 VSWR, a VSWR of approximately less than 2.0:1, a nominal gain of approximately 0 dBMEG, a maximum power of approximately 60 W, a nominal impedance of approximately 50Ω, a nominal ground plane requirement range of approximately 34 inches in diameter to approximately 36 inches in diameter, an omni-directional radiation pattern, and a vertical polarization with field diversity.

FIG. 2 illustrates, in a bottom view, a mountable antenna apparatus 1000, in accordance with the present invention, wherein the housing member 100 comprises a housing recess 110 formed in its bottom surface, and wherein the housing member 100 comprises an annulus 120 having at least one bayonet pin 130 thereon formed and being disposed within the housing recess 110. The bayonet pin 130 is disposed at an angular location greater than 0° (zero degrees) from a centerline of the housing for facilitating positioning of the antenna assembly. The antenna assembly comprises a contact 310 being disposed through the housing member 100 and within the housing recess 110. The apparatus 1000 further comprises a housing gasket 400 disposed on a bottom surface of the housing member 100. The housing gasket 400 can be adhered to the housing member bottom surface (not shown). The housing gasket 400 protects the antenna circuitry as well as the connection between the contact 310 and the NMO mount 2000 (shown in FIG. 3). The housing gasket 400 further provides shock and vibration absorbance. The housing gasket 400 comprises a material such as a polymer, a foam, a rubber, a silicone, and a composite material, by example only. The annulus 120 comprises a material such as brass, brass plating, chromium, and chrome-plating, by example only.

Figure 3:
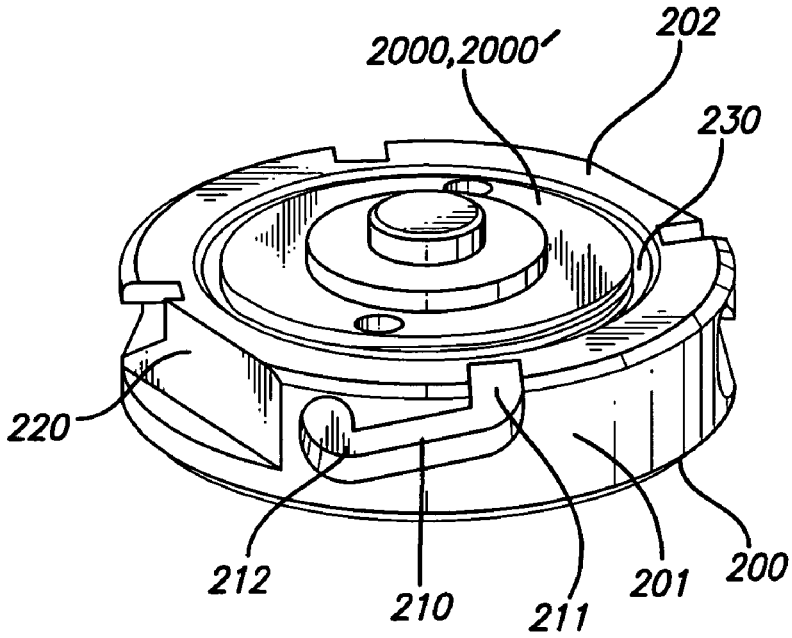
FIG. 3 is a perspective view of a bayonet adapter threaded on an NMO mount, whereby a retrofitted NMO mount is effected, in accordance with the present invention.

FIG. 3 illustrates, in a perspective view, a bayonet adapter 200 threaded over an NMO mount 2000 (work-piece), whereby a retrofitted NMO mount 2000' is effected, in accordance with the present invention. The bayonet adapter 200 can comprise a structure such as a nut. The bayonet adapter 200 comprises a ramped recess 210 formed on its outer surface for engaging each bayonet pin 130 and has an internal threading (not shown in FIG. 3) for mating an NMO mount 2000. The ramped recess 210 includes an insertion notch 211 for facilitating entry of the bayonet pin 130. The bayonet adapter 130 comprises a setback 220 formed on its outer surface 201 for facilitating positioning of the antenna assembly. The bayonet adapter 200 comprises a material such as chromium and chrome-plating, by example only. The housing member 100, containing the antenna assembly, is easily installed on the NMO mount 2000 by positioning the bayonet pin 130 in the insertion notches 211 and downwardly rotating the housing member 100, thereby sliding the bayonet pin 130 into a position 212. The setback 220 assists an installer in identifying the desired ultimate orientation of the housing member 100.

Figure 4:
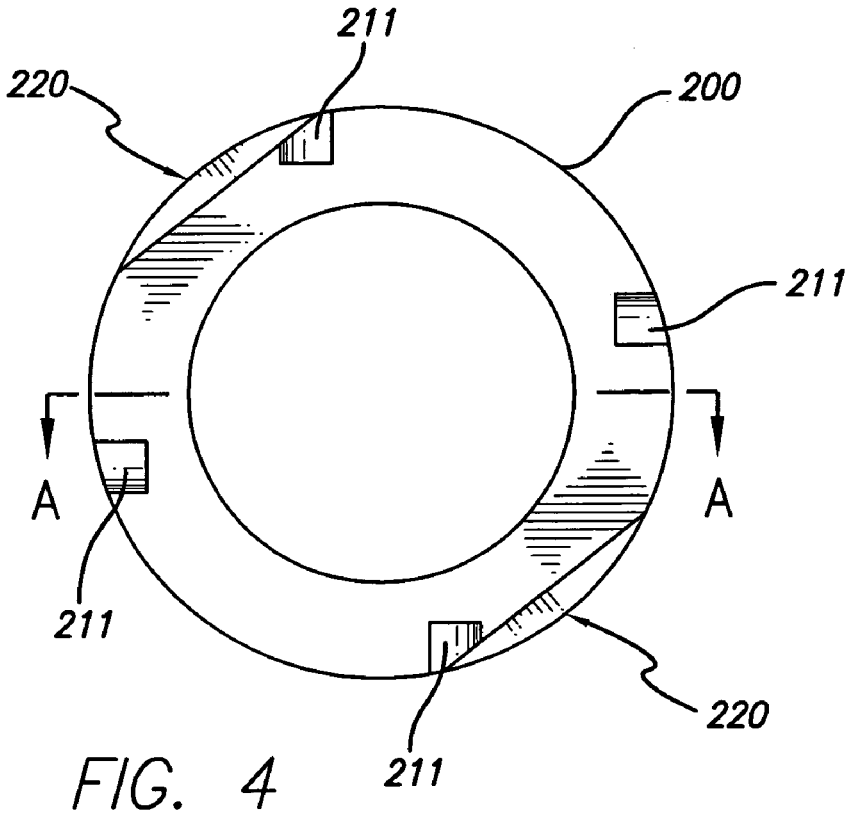
FIG. 4 is a top view of the bayonet adapter, showing the orientation of two setbacks and the locations of four ramped recesses having insertion notches therein formed in relation to a cross section A-A, by example only and in accordance with the present invention.

FIG. 4 illustrates, in a top view, the bayonet adapter 200, showing the orientation of two setbacks 220 and the locations of four ramped recesses 210 with insertion notches 211 therein formed in relation to a cross-section A-A, by example only and in accordance with the present invention.

Figure 5:
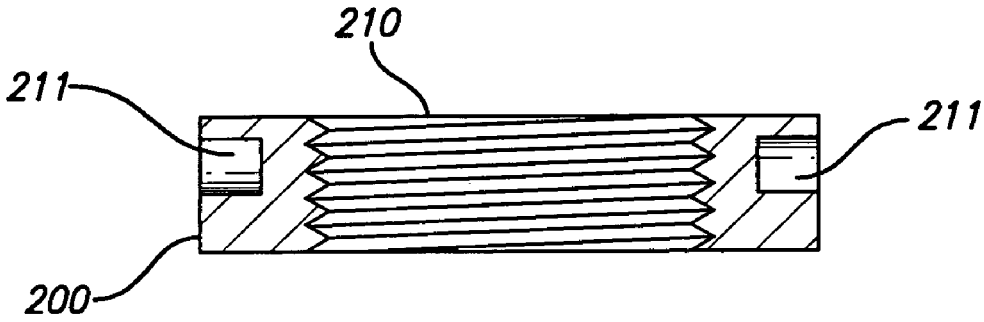
FIG. 5 is a cross-sectional view of the bayonet adapter of FIG. 4, showing the insertion notches therein formed in relation to a cross section A-A, by example only and in accordance with the present invention.

FIG. 5 illustrates, in a cross-sectional view, the bayonet adapter 200 of FIG. 4, showing the orientation of the insertion notches 211 of the four ramped recesses 210 in relation to a cross-section A-A, by example only and in accordance with the present invention.

Figure 6:
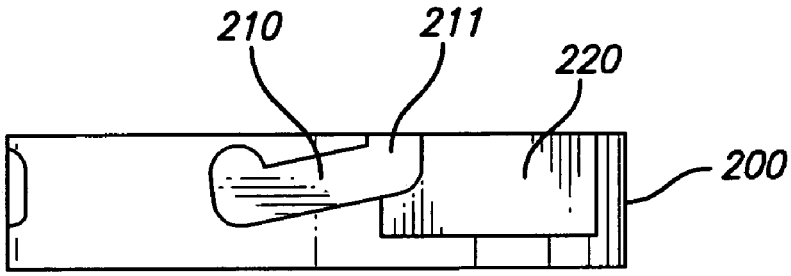
FIG. 6 is a side view of the bayonet adapter of FIG. 4, showing the orientation of two setbacks and the locations of four ramped recesses having insertion notches therein formed, by example only and in accordance with the present invention.

FIG. 6 illustrates, in a side view, the bayonet adapter 200 of FIG. 4, showing the orientation of two setbacks 220 and the locations of four ramped recesses 210 with insertion notches 211 therein formed, by example only and in accordance with the present invention.

Figure 7:
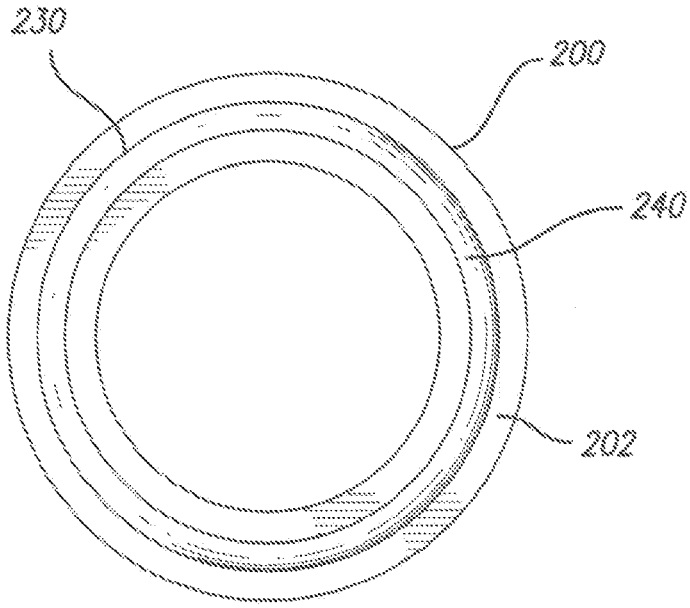
FIG. 7 is a bottom view of the bayonet adapter of FIG. 4, showing a seat for accommodating a seal, in accordance with the present invention.

FIG. 7 illustrates, in a bottom view, the bayonet adapter 200 of FIG. 4, showing a seat 230 for accommodating a seal 240, in accordance with the present invention. The seat 230 is formed in a bottom surface 202 of the bayonet adapter 200; and the seal 240 is disposed therein for interfacing the NMO mount (not shown). The seal 240 comprises a structure such as an O-ring, a washer, and a gasket, wherein the seal 240 comprises an elastic material such as a silicone, a rubber, a fluorinated polymer, and an ethylenepropylenediene monomer (EPDM), by example only.

Figure 8:
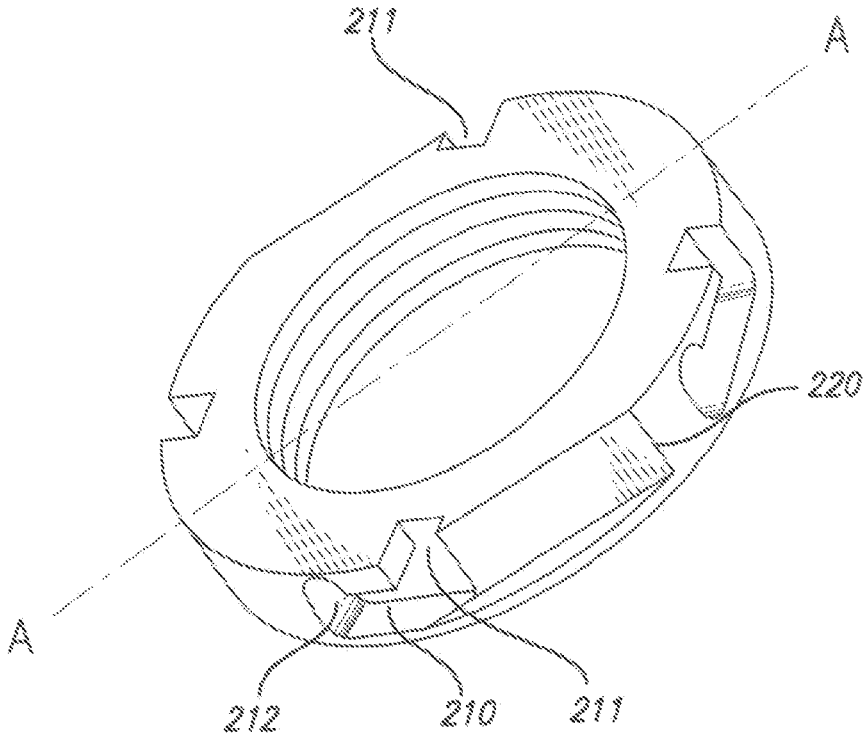
FIG. 8 is a perspective view of a bayonet adapter of FIG. 4, showing the orientation of two setbacks and the locations of four ramped recesses having insertion notches therein formed in relation to a cross section A-A, by example only and in accordance with the present invention.

FIG. 8 illustrates, in a perspective view, a bayonet adapter 200 of FIG. 4, showing two setbacks 220 and the locations of four ramped recesses 210 with insertion notches 211 therein formed in relation to a cross-section A-A, by example only and in accordance with the present invention.

The present method M of mounting an antenna apparatus 1000 comprises the steps of providing a housing member 100, providing a bayonet adapter 200, providing an antenna assembly within the housing member 100, removing a preexisting NMO ring from an NMO mount 2000 (workpiece), retrofitting the NMO mount 2000 with the bayonet adapter 200, thereby effecting a retrofitted NMO mount 2000', and fastening the antenna assembly within the housing member 100 to the retrofitted NMO mount 2000'. The method M further comprises the step of providing the housing member 100 with an aerodynamic configuration. The aerodynamic configuration providing step includes providing at least one feature such as an ogive, an ogivoid, a semi-ogivoid, a hemi-ogivoid, and a quasi-ogivoid. The method M further comprises the step of providing the housing member 100 with a convex feature 101 for facilitating manual installation and repositioning of the antenna assembly, wherein the convex feature 101 providing step comprises providing a configuration such as a parabola, a paraboloid, a semi-paraboloid, a hemi-paraboloid, a quasi-paraboloid, an ellipse, an ellipsoid, a semi-ellipsoid, a hemi-ellipsoid, and a quasi-ellipsoid.

Information as herein shown and described in detail is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims.

Moreover, no requirement exists for a device or method to address each and every problem sought to be resolved by the present invention, for such to be encompassed by the present claims. Furthermore, no element, component, or method step in the present disclosure is intended to be dedicated to the public regardless of whether the element, component, or method step is explicitly recited in the claims. However, various changes and modifications in form, material, and fabrication material detail may be made without departing from the spirit and scope of the inventions as set forth in the appended claims and should be readily apparent to those of ordinary skill in the art. No claim herein is to be construed under the provisions of 35 U.S.C. § 112, sixth paragraph, unless the element is expressly recited using the phrase "means for."

INDUSTRIAL APPLICABILITY

The present invention industrially applies to antenna apparatuses and methods. More particularly, the present invention industrially applies to antenna apparatuses and methods for vehicles. Even more particularly, the present invention industrially applies to mountable antenna apparatuses and methods for vehicles.

What is claimed is:

1. A mountable antenna apparatus, comprising:

a housing member;

a bayonet adapter; and an antenna assembly being disposed within the housing member, wherein the housing member comprises a housing recess formed in its bottom surface, wherein the housing member comprises an annulus having at least one bayonet pin thereon formed and being disposed within the housing recess, wherein the bayonet adapter comprises at least one ramped recess formed on its outer surface for engaging each corresponding at least one bayonet pin and having an internal threading for mating an NMO mount, and wherein the antenna assembly comprises a contact being disposed through the housing member and within the housing recess.

2. An apparatus, as recited in claim 1, wherein the housing member comprises an aerodynamic configuration.

3. An apparatus, as recited in claim 2, wherein the aerodynamic configuration comprises at least one feature selected from a group consisting essentially of an ogive, an ogivoid, a semiogivoid, a hemi-ogivoid, and a quasi-ogivoid.

4. An apparatus, as recited in claim 1, wherein the housing member comprises a convex feature for facilitating manual installation and repositioning of the antenna assembly.

5. An apparatus, as recited in claim 4, wherein the convex feature comprises at least one configuration selected from a group consisting essentially of a parabola, a paraboloid, a semi-paraboloid, a hemi-paraboloid, a quasi-paraboloid, an ellipse, an ellipsoid, a semi-ellipsoid, a hemi-ellipsoid, and a quasi-ellipsoid.

6. An apparatus, as recited in claim 1, wherein the at least one bayonet pin is disposed at an angular location greater than zero degrees from a centerline of the housing for facilitating positioning of the antenna assembly, wherein the bayonet adapter comprises at least one insertion notch formed on its outer surface for facilitating positioning of the antenna assembly, wherein the bayonet adapter comprises at least one setback for assisting an installer in identifying the desired ultimate orientation of the housing, and wherein the bayonet adapter comprises a seat formed in its bottom surface and a seal disposed therein for interfacing the NMO mount.

7. An apparatus, as recited in claim 6, wherein the seal comprises an O-ring, a washer, and a gasket, and wherein the seal comprises an elastic material selected from a group consisting essentially of a silicone, a rubber, a fluorinated polymer, and an ethylenepropylenediene monomer.

8. An apparatus, as recited in claim 1, further comprising a housing gasket disposed on a bottom surface of the housing member.

9. An apparatus, as recited in claim 8, wherein the housing gasket is adhered to the housing member bottom surface.

10. An apparatus, as recited in claim 9, wherein the housing member comprises a material selected from a group consisting essentially of a polymer and a composite material.

11. An apparatus, as recited in claim 10, wherein the polymer comprises a plastic selected from a group consisting essentially of a molded ABS plastic and an injection molded ABS plastic.

12. An apparatus, as recited in claim 8, wherein the housing gasket comprises at least one material selected from a group consisting essentially of a polymer, a foam, a rubber, a silicone, and a composite material.

13. An apparatus, as recited in claim 1, wherein the housing member is disposed with a leading edge oriented toward the front of a vehicle and a trailing edge oriented toward the rear of the vehicle.

14. An apparatus, as recited in claim 1, wherein the housing member is disposed with a leading edge and a trailing edge being oriented outboard of the vehicle.

15. An apparatus, as recited in claim 1, wherein the bayonet adapter comprises a material selected from a group consisting essentially of chromium and chrome plating.

16. An apparatus, as recited in claim 1, wherein the annulus comprises a material selected from a group consisting essentially of brass, brass plating, chromium, and chrome-plating.

17. An apparatus, as recited in claim 1, wherein the antenna assembly comprises a frequency range of approximately 150 MHz to approximately 155 MHz.

18. An apparatus, as recited in claim 1, wherein the antenna assembly comprises a bandwidth of approximately 5 MHz at approximately 2.0:1 VSWR.

19. An apparatus, as recited in claim 1, wherein the antenna assembly comprises a VSWR of approximately less than 2.0:1.

20. An apparatus, as recited in claim 1, wherein the antenna assembly comprises a nominal gain of approximately 0 dBMEG.

21. An apparatus, as recited in claim 1, wherein the antenna assembly comprises a maximum power of approximately 60 W.

22. An apparatus, as recited in claim 1, wherein the antenna assembly comprises a nominal impedance of approximately 50 Ω.

23. An apparatus, as recited in claim 1, wherein the antenna assembly comprises a nominal ground plane requirement range of approximately 34 inches in diameter to approximately 36 inches in diameter.

24. An apparatus, as recited in claim 1, wherein the antenna assembly comprises an omni-directional radiation pattern.

25. An apparatus, as recited in claim 1, wherein the antenna assembly comprises a vertical polarization with field diversity.

26. A mountable antenna apparatus, comprising:

a housing member;

a bayonet adapter; and an antenna assembly being disposed within the housing member, wherein the housing member comprises a housing a recess formed in its bottom surface, wherein the housing member comprises an annulus having at least one bayonet pin thereon formed and being disposed within the housing recess, wherein the bayonet adapter comprises at least one ramped recess formed on its outer surface for engaging each corresponding at least one bayonet pin and having and internal threading for mating with an antenna mount, wherein the antenna assembly comprises a contact being disposed through the housing member and within the housing recess, wherein the housing member comprises an aerodynamic configuration, and wherein the aerodynamic configuration comprises at least one feature selected from a group consisting essentially of an ogive, an ogivoid, a semi-ogivoid, a hemi-ogivoid, and a quasi-ogivoid.

27. A method of mounting an antenna apparatus including a housing member having a recess formed in its bottom surface and an annulus with at least bayonet pin thereon formed and disposed within the housing recess, a bayonet adapter having at least one ramped recess formed on its outer surface for engaging each corresponding at least one bayonet pin and having internal threading for mating an NMO mount, and having at least one insertion notch formed on its outer surface for facilitating positioning of the antenna assembly, and an antenna assembly within the housing member, the method comprising:

removing a preexisting NMO ring from an NMO mount;

retrofitting the NMO mount with the bayonet adapter, thereby effecting a retrofitted NMO mount;

fastening the antenna assembly within the housing member to the retrofitted NMO mount, wherein the fastening step comprises:

positioning the at least one bayonet pin in the corresponding at least one insertion notch; and downwardly rotating the housing member, thereby sliding the at least one bayonet pin into at least one corresponding terminal position in the ramped recess.

28. A method, as recited in claim 27, wherein the housing member includes an aerodynamic configuration comprising at least one feature selected from a group consisting essentially of an ogive, an ogivoid, a semi-ogivoid, a hemi-ogivoid, and a quasi-ogivoid.

29. A method, as recited in claim 28, wherein the housing member includes a convex feature for facilitating manual installation and repositioning of the antenna assembly, wherein the convex feature comprises at least one configuration selected from a group consisting essentially of a parabola, a paraboloid, a semi-paraboloid, a hemi-paraboloid, a quasi-paraboloid, an ellipse, an ellipsoid, a semi-ellipsoid, a hemi-ellipsoid, and a quasi-ellipsoid.

* * * * *